US006846254B2

(12) United States Patent
Baxter

(10) Patent No.: US 6,846,254 B2
(45) Date of Patent: Jan. 25, 2005

(54) BREAK AWAY SPORTS TRAINING DEVICE

(76) Inventor: Malcolm M. Baxter, 212 Adams St. Floor 2, Hoboken, NJ (US) 07030

( * ) Notice: Subject to any disclaimer, the term of this patent is extended or adjusted under 35 U.S.C. 154(b) by 0 days.

(21) Appl. No.: 10/392,588

(22) Filed: Mar. 20, 2003

(65) Prior Publication Data

US 2004/0185969 A1 Sep. 23, 2004

(51) Int. Cl.[7] ..... A63B 69/00
(52) U.S. Cl. ..... 473/450; 473/458
(58) Field of Search ..... 473/207, 212, 473/213, 214, 215, 216, 217, 422, 450, 458, 277

(56) References Cited

U.S. PATENT DOCUMENTS

| | | | | | |
|---|---|---|---|---|---|
| 2,450,162 | A | | 9/1948 | Promen | |
| 4,046,143 | A | * | 9/1977 | Bell | 128/882 |
| 4,239,228 | A | | 12/1980 | Norman et al. | |
| 4,377,284 | A | * | 3/1983 | Okerlin | 473/450 |
| 4,706,957 | A | * | 11/1987 | Jackson | 473/207 |
| 4,747,779 | A | * | 5/1988 | Gerstung | 434/247 |
| 4,892,317 | A | * | 1/1990 | Corder, Jr. | 473/212 |
| 4,960,280 | A | * | 10/1990 | Corder, Jr. | 473/212 |
| 5,016,885 | A | * | 5/1991 | Quigley | 473/217 |
| D352,572 | S | * | 11/1994 | Pustizzi, Jr. | D29/120.2 |
| 5,593,073 | A | * | 1/1997 | Finnegan | 224/183 |
| 5,601,285 | A | | 2/1997 | Baxter, III | |
| 5,938,548 | A | * | 8/1999 | Upshaw | 473/453 |

* cited by examiner

*Primary Examiner*—Gregory Vidovich
*Assistant Examiner*—Nini F. Legesse
(74) *Attorney, Agent, or Firm*—Kenneth P. Glynn, Esq.

(57) ABSTRACT

A sports training device with a breakaway feature, includes a first yoke for removable attachment to a first wrist of a user and a second yoke for removable attachment to a second wrist of the user, and a breakaway connecting strap. The first yoke and second yoke are made of flexible material, being elongated, with a middle portion and two opposing ends. The opposing ends have complementary attachment mechanisms for removably attaching them to one another. The second yoke has a temporary attachment breakaway feature to connect to the strap at the middle portion of the second yoke. The connecting strap has a first end permanently attached to the middle portion of the first yoke, and a second end temporary yoke attachment for attachment to the second yoke, creating a predetermined breakaway resistance when connected to one another.

17 Claims, 2 Drawing Sheets

BREAK AWAY SPORTS TRAINING DEVICE

BACKGROUND OF THE INVENTION

1. Field of the Invention

The present invention is directed to ball sports catching and throwing training device that forces players to catch or receive the ball with both hands before throwing. The device is uniquely set up to break away by the mere pulling apart of the wrists, and is useful for softball, baseball, basketball, football and other ball games. It involves two yokes that fit around a user's wrists that are attached via a strap that is permanently attached to only on of the yokes.

2. Information Disclosure Statement

The following patents represent various sports training devices involving the use of wrist attachments:

U.S. Pat. No. 5,601,285 involves a baseball catching training device. It includes a first yoke for removable attachment to the first wrist of a user and a second yoke for removable attachment to a second wrist of the user. The first yoke and the second yoke are made of flexible material, are elongated and have a middle portion and each have two opposing ends, the opposing ends having complementary attachment mechanisms for removably attaching one opposing end to an opposite opposing end. It also includes a connecting strap having a first and a second end, the first end being connected to the middle portion of the first yoke and the second end being connected to the middle portion of the second yoke. The connecting strap is flexible, stretchable and elongated and has a length no greater than 18 inches. In other preferred embodiments, the attachment mechanisms are filamentary loop and hook mechanisms.

U.S. Pat. No. 4,239,228 describes an adjustable tether for joining the upper arms of a golfer together to coordinate the relative motion of the arms of the golfer during his swing. The arm joining tether comprises first and second generally Y-shaped flexible straps each having a stem portion which is bifurcated so as to terminate in branch portions which may be joined by suitable fasteners to form arm engaging loops. The stem portions may also be joined by a suitable two-element separable fastener and when in use, the joined stem portions span the chest of the user. It has been found that mating hook and loop type fasteners are ideally suited for joining the Y-shaped flexible strap members, one to the other, and in coupling the branch portions of each to form the aforesaid arm engaging loops. Further, each of the individual Y-shaped strap members is marked with a suitable graduated marking to facilitate the sizing of the device to golfers of different physical size.

U.S. Pat. No. 2,450,162 describes a golf practice device comprising a plurality of straps, one adapted to form a closed loop loosely positioned about one arm in the proximity of its elbow and another to form a like loop about the other arm; elastic members, at least one of which is attached to each of said loops to form a ring within the latter adapted to fit snugly about the arm for holding said loop in place; and means joining said loops for limiting the distance by which the arms may be separated from each other while making a golf stroke.

Notwithstanding the prior art, the present invention is neither taught nor rendered obvious thereby.

SUMMARY OF THE INVENTION

The present invention involves a ball sports device that is a catching and throwing training device for enhancing or encouraging the use of two hands. This reduces "drops", increases outs in baseball and softball, and speeds up return throws to the infield. The device includes a first yoke for removable attachment to a first wrist, and a second yoke for removable attachment a second wrist of a user. The first yoke and the second yoke are made of flexible material, are elongated and each have a middle portion and two opposing ends. The opposing ends having complementary attachment mechanisms for removably attaching opposing ends to one another. It also includes a connecting strap having a first and a second end, the first end is permanently connected to the first yoke at the middle portion of the first yoke, and the second end is removably connected to the second yoke for easy breakaway separation by having opposing attachment mechanisms. The connecting strap is flexible but not elastic; when tension comes to it by pulling wrists apart to throw a ball or do something else, the strap disengages automatically from the second yoke. The user may reattach when needed. In some preferred embodiments, the attachment mechanisms are filamentary loop and hook mechanisms. Alternatively, snaps, a hook and loop, or other quick separating attachment may be used for the connections of the yoke ends and/or the trap to second yoke connection.

The present invention also relates to training methods using the present invention devices described.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

As stated in the summary above, the present invention is a ball game; e.g. football/baseball/softball, catching and throwing device which disciplines and accustoms user, by causing the user to automatically use both hands in concert where appropriate or advantageous. For example, in baseball and softball, the present invention device disciplines the user to automatically move the non-catching arm in concert with the gloved arm, to use two hands when attempting to catch a baseball. A quick breakaway of the two wrist yokes enables the catching user to then throw the ball quickly. The end result is that the user makes fewer errors and quicker throws. The baseball catching training device is a lightweight, simple to use mechanism. Due to its size and weight, it is easily transportable and can be used anywhere. The present invention sports training device consists of two wrist enclosing yokes, and a connecting strap for the two yokes. The connecting strap is permanently attached to a first yoke and temporarily attached and reattached to the second yoke, as desired.

Figure 1:
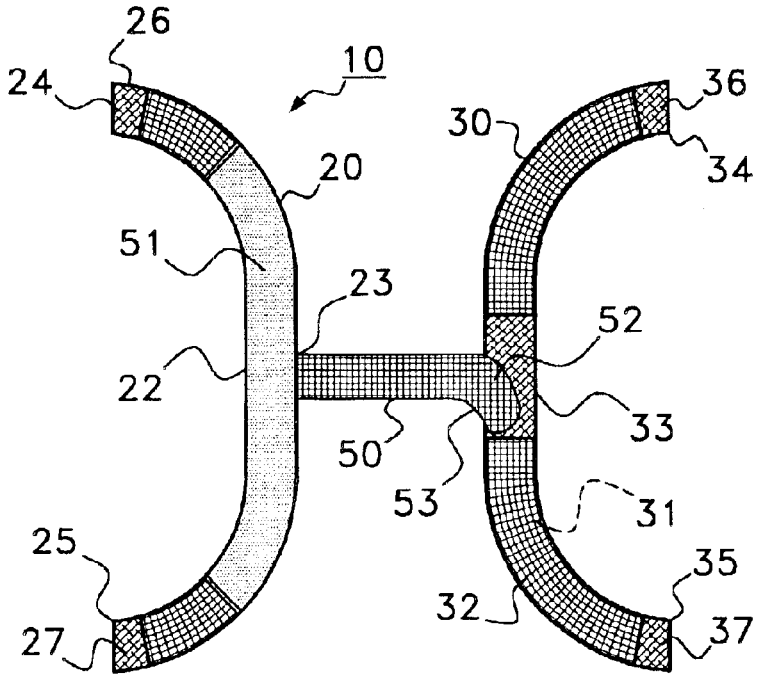
FIG. 1 shows a top view of a present invention break away sports training device.
Figure 2:
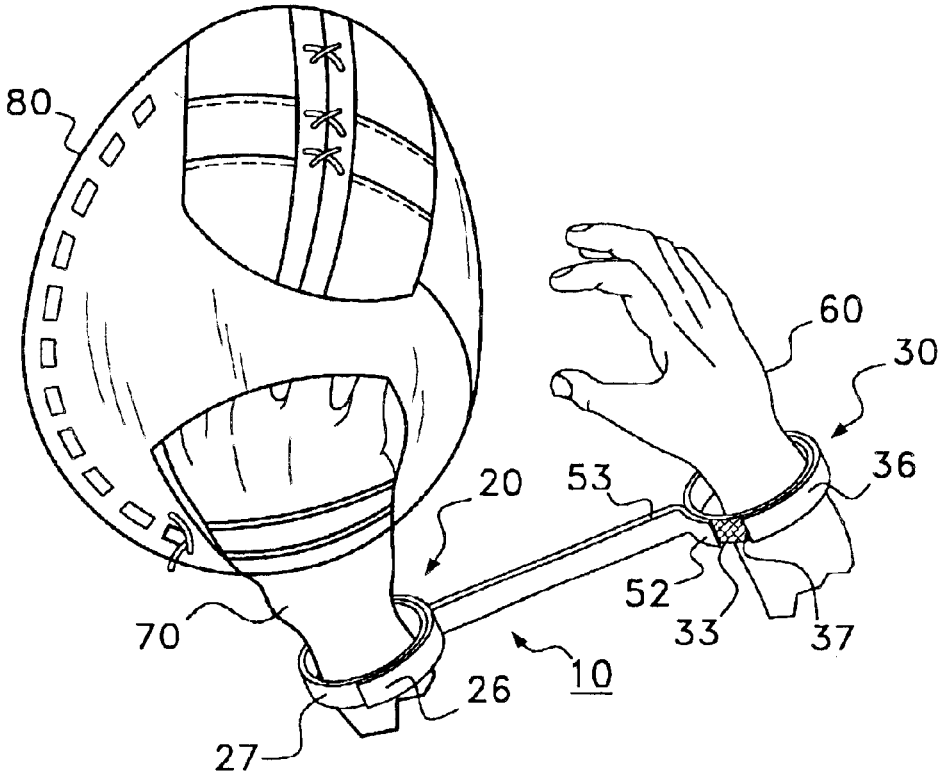
FIG. 2 shows the present invention device connected to the wrist of a baseball player.

Referring to FIG. 1, the present invention involves a sports catching and throwing training device 10 which fosters or encourages the use of both hands when attempting to catch a baseball or receive a football hike or pass. Referring also to FIG. 2, a preferred embodiment of the baseball catching training device 10 is illustrated as it would appear on a user in a ballgame. The present invention sports training device 10 includes a pair of yokes, first yoke 20 and second yoke 30, which are designed for attachment to a pair of wrists 60 and 70. Yokes 20 and 30 are preferably made from an elongated, flexible material that is non-elastic. This piece could be constructed from, but is not limited to, flexible plastics, rubber based materials, injection molded plastics, and other such flexible materials, woven synthetics, such as nylon strapping, is preferred. Yokes 20 and 30 have a middle section 22 and 32 and a pair of opposing ends 24, 25 and 34, 35, respectively. In the middle sections 22 and 23 are padded sections to reduce wrist irritation, such as foam pads 31 and 51.

Affixed to each pair of opposing ends 24,25 and 34, 35 of the first yoke 20 and the second yoke 30, are complimentary attachment mechanisms 26, 27 and 36, 37, which permit one end of the pair of opposing ends 24, 25 and 34, 35 to be removably attached to the remaining end, respectively. This allows for easy attachment and removal of the present invention device 10 from the wrists 60 and 70 off a user. In some preferred embodiments, the complementary attachment mechanisms 26, 27 and 36, 37 are looped and hooked filament attachment mechanisms, commonly known as "Velcro". In general, however, the complementary attachment mechanisms 26, 27 and 36, 37 may be any of a variety of attachment mechanisms which allow for removable attachment of the baseball catching training device 10, including straps, buttons, snaps, quick release hooks, etc.

The present invention sports training device 10 further includes a connecting strap 50. The connecting strap 50 is preferably constructed from an elongated, flexible, but non-stretchable material. As was the case for the yokes, it can also be constructed from a wide range of available materials, and woven synthetic material is one choice. Strap 50 is permanently connected at end 23 to first yoke 20. At opposite end 52 there is a temporary attachment means 53, such as a single hook or velcro-type hook or loop filaments, to attach to complimentary attachment means 33 on second yoke 30, e.g. loop or velcro complement.

In some preferred embodiments, the length of the connecting strap 50 is no greater than 18 inches, and preferably no greater than 14 inches in length. The connecting strap 50 has a pair of ends 23 and 52 which are connected to the middle sections 23 and 33 of the yokes 20 and 30, respectively, the later being temporarily connected for quick breakaway without the need to use the fingers or hands to pull the connecting strap 50 away from second yoke 30. As illustrated, in FIGS. 2 through 5, this keeps both arms in sequence and synchronized when catching or receiving a ball.

Figure 3:
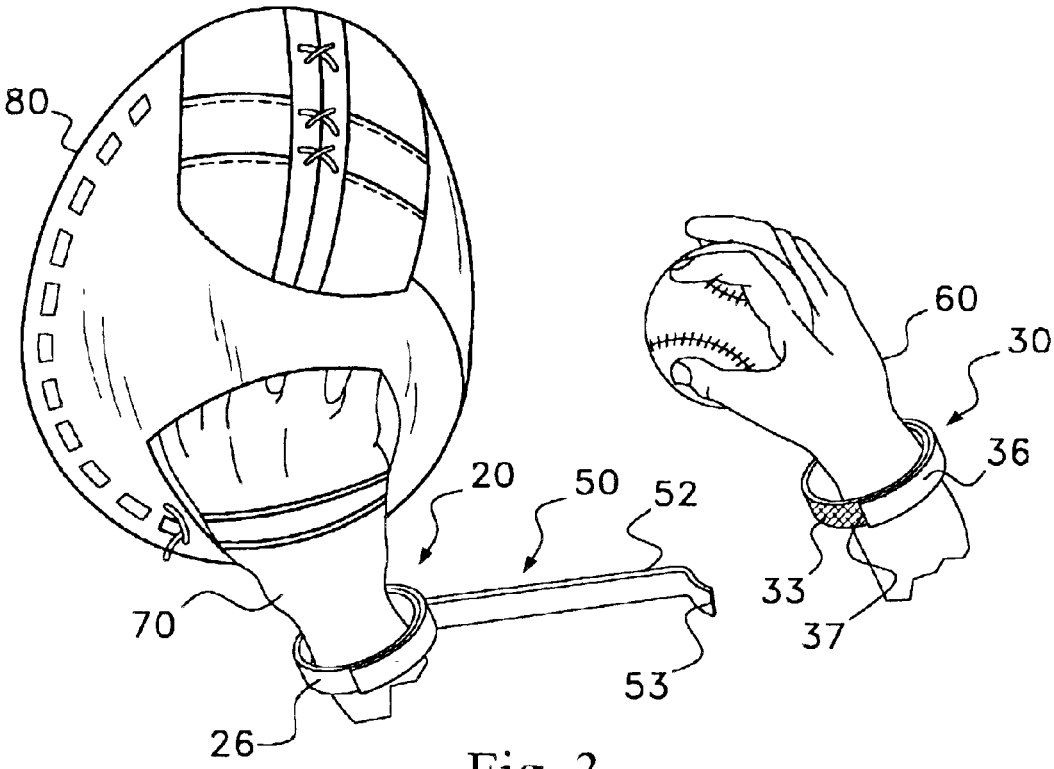
FIG. 3 shows a perspective view of the present invention device of FIG. 2 in an open position; and, FIG. 4 shows a football quarterback hands using the present invention device for a hike.

FIG. 2 shows the user's hands in a ball catching mode, after the ball is caught in the glove and free hand (wrist 60), the ball is taken from the glove and the wrist 60 and 70 are pulled apart, separating the strap 50 from second yoke 30, and allowing the free hand 30 to throw the ball, as shown in FIG. 3. In this FIG. 3, identical components are identically numbered and need not be repeated here. Note that FIG. 3 illustrates two important features and advantages of the preset invention. First, the strap or a strap section is not connected to the throwing arm and does not create interference or weight or aerodynamic problem for the thrower. Second, the throwing arm will not slap the thrower in the side of the head with a strap section, because the second yoke is free of all strap.

The arrangement of the present invention device 10 as shown in FIGS. 2 and 3 could be reversed. Once a player has learned to throw a caught ball properly (away from the head), the first yoke 20 may be attached to the free hand and the second yoke 30 may be attached to the glove hand. This will allow an experienced player to reattach the strap and yoke quicker with the free hand.

Figure 4:
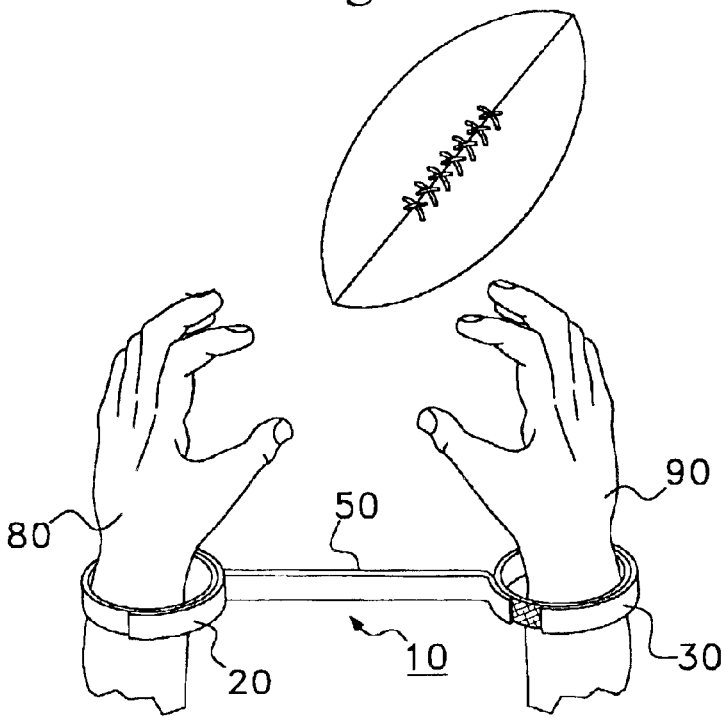

FIG. 4 shows the same present invention device 10 shown above, but on the hands 80 and 90, of a football player. This enables the football player to keep the two hands together for the catch or for receiving the hike, and to breakaway for passing or other move.

Obviously, numerous modifications and variations of the present invention are possible in light of the above teachings. It is therefore understood that within the scope of the appended claims, the invention may be practiced otherwise than as specifically described herein.

What is claimed is:

1. A sports training device with a breakaway feature, which consists of:

(a) a first yoke for removable attachment to a first wrist of a user and a second yoke for removable attachment to a second wrist of said user, said first yoke and said second yoke being made of flexible material, being elongated and having a middle portion and each having two opposing ends, said opposing ends having complementary attachment mechanisms for removably attaching one opposing end to an opposite opposing end, said second yoke having breakaway feature temporary attachment means for attachment of a connecting strap to said middle portion of said second yoke;

(b) a connecting strap having a first end and a second end, said first end being permanently attached to said middle portion of said first yoke, said second end having yoke attachment means for attachment to said temporary attachment means of said second yoke, said temporary attachment means and said yoke attachment means creating a predetermined breakaway resistance when connected to one another, said connecting strap being permanently attached to said middle portion of said first yoke at a location facing said second yoke when said connecting strap is temporarily connected to said second yoke, said connecting strap being a flexible, non-elastic strap;

wherein when a user wears said first yoke on a first wrist, and wears said second yoke on a second wrist, and said yoke attachment means of said connecting strap is removably attached to said temporary attachment means of said second yoke, said connecting strap is connected from said first yoke to said second yoke along a path that is the shortest distance between the first yoke and the second yoke, said connecting strap may be separated from said second yoke by merely pulling said first wrist away from said second wrist.

2. The device of claim 1 wherein said connecting strap has a length no greater than 14 inches.

3. The device of claim 1 wherein said complementary attachment mechanisms are looped and hooked filament attachment mechanisms.

4. The device of claim 3 wherein said connecting strap has a length no greater than 14 inches.

5. The device of claim 1 wherein said middle portions include a first layer, being a flexible, non-elastic layer, and a second layer, being a padded layer.

6. The device of claim 5 wherein said padded layer is a dense foam layer.

7. The device of claim 1 wherein said temporary attachment means and said yoke attachment means are complementary hooked and looped filament attachment mechanisms.

8. The device of claim 1 wherein said first yoke and said second yoke are made of woven strap material.

9. A method of training a ball player to catch balls with two hands, which comprises:

(a) attaching to the wrists of a user, a sports training device with a breakaway feature, which consists of:

(i) a first yoke for removable attachment to a first wrist of a user and a second yoke for removable attachment to a second wrist of said user, said first yoke and said second yoke being made of flexible material, being elongated and having a middle portion and each having two opposing ends, said opposing ends having complementary attachment mechanisms for removably attaching one opposing end to an opposite opposing end, said second yoke having breakaway feature temporary attachment means for temporary attachment of a connecting strap to said middle portion of said second yoke, said connecting strap being a flexible, non-elastic strap;

the connecting strap having a first end and a second end, said first end being permanently attached to said middle portion of said first yoke, said second end having yoke attachment means for temporary attachment to said temporary attachment means of said second yoke, said temporary attachment means and said yoke attachment means creating a predetermined breakaway resistance when connected to one another, said connecting strap being permanently attached to said middle portion of said fist yoke at a location facing said second yoke when said connecting strap is temporarily connected to said second yoke;

wherein when a user wears said first yoke on a first wrist, and wears said second yoke on a second wrist, and said yoke attachment means of said connecting strap is removably attached to said temporary attachment means of said second yoke, and is connected from said first yoke to said second yoke along a path that is the shortest distance between the first yoke and the second yoke, said connecting strap may be separated from said second yoke by merely pulling said first wrist away from said second wrist:

(b) connecting said connecting strap at its second end to said second yoke;

(c) projecting a ball toward said user for catching said ball such that said user is caused by said device to move both hands towards said ball to encourage said user to effect a two-handed catch.

10. The method of claim 9 wherein said method further includes having said user breakaway said second end of said strap from said second yoke by moving said first wrist away from said second wrist, prior to disengaging said ball.

11. The method of claim 9 wherein said complementary attachment mechanisms are looped and hooked filament attachment mechanisms.

12. The method of claim 9 wherein said connecting strap has a length no greater than 14 inches.

13. The method of claim 12 wherein said complementary attachment mechanisms are looped and hooked filament attachment mechanisms.

14. The method of claim 9 wherein said middle portions include a first layer, being a flexible, non-elastic layer, and a second layer, being a padded layer.

15. The method of claim 14 wherein said padded layer is a dense foam layer.

16. The method of claim 9 wherein said temporary attachment means and said yoke attachment means are complementary hooked and looped filament attachment mechanisms.

17. The method of claim 9 wherein said first yoke and said second yoke are made of woven strap material.

* * * * *